US005908166A

United States Patent [19]

Freitas et al.

[11] Patent Number: 5,908,166

[45] Date of Patent: Jun. 1, 1999

[54] PROCESS FOR IRON ORE PELLETS PRODUCTION

[75] Inventors: Geraldo Gonçalves Freitas; Marcelo Da Silva Kelin; João Júlio Ruschid Tolentino, all of Vitória-Espírito Santo, Spain

[73] Assignee: Companhia Vale Do Rio Doce, Minas Gerais, Brazil

[21] Appl. No.: 08/950,619

[22] Filed: Oct. 15, 1997

[51] Int. Cl.[6] ..... B02C 4/02

[52] U.S. Cl. ..... 241/29; 241/21

[58] Field of Search ..... 241/21, 29

[56] References Cited

U.S. PATENT DOCUMENTS

| | | | |
|---|---|---|---|
| 3,830,612 | 8/1974 | Komarek | 425/194 |
| 3,897,183 | 7/1975 | Hofmann et al. | 425/78 |
| 3,933,316 | 1/1976 | Jones | 241/170 |
| 3,986,864 | 10/1976 | Hofmann et al. | 75/3 |
| 4,097,215 | 6/1978 | Komarek | 425/471 |
| 4,192,471 | 3/1980 | Beckman et al. | 241/185 R |
| 4,934,613 | 6/1990 | Kukuch | 241/39 |
| 5,124,008 | 6/1992 | Rendall et al. | 204/61 |
| 5,203,513 | 4/1993 | Keller et al. | 241/30 |
| 5,221,051 | 6/1993 | Hashimoto et al. | 241/29 |
| 5,427,607 | 6/1995 | Cristovici et al. | 75/749 |
| 5,547,357 | 8/1996 | Bergendahl | 425/79 |
| 5,630,202 | 5/1997 | Bergendahl | 419/69 |
| 5,666,638 | 9/1997 | Bergendahl | 419/66 |
| 5,695,130 | 12/1997 | Csendes | 241/19 |

*Primary Examiner*—Joseph J. Hail, III
*Assistant Examiner*—William Hong
*Attorney, Agent, or Firm*—Helfgott & Karas, P.C.

[57] ABSTRACT

The present invention concerns a process for iron ore pellets production comprising at least one iron ore crushing stage in a roller press for the production of iron ore pellets. The crushing stage(s) can be done prior or after grinding, or still defined by successive passages of the material through the foregoing crushing stage.

10 Claims, 4 Drawing Sheets

PROCESS FOR IRON ORE PELLETS PRODUCTION

FIELD OF THE INVENTION

The present invention relates to a process for iron ore pellets production and more specifically to a process in which an equipment for reducing the size of the solid iron ore particles is used.

BACKGROUND OF THE INVENTION

As it is known, pelletizing is an agglomeration process whereby the fine iron ore particles are converted into spherical bodies with size ranging from 8 to 18 mm. These spherical bodies having an appropriate physical, chemical and metallurgical properties for use in steel mill's reduction reactors.

The quality of the product yielded by the pelletizing process has direct relation with the material size fed to the process, and it is suitable that at least 50% of the raw material charged to the process have a size less than 0.40 mm (325 mesh) and a specific surface of 1200 $cm^2/g$. Usually, the ore fines employed in pelleting have a granulometry 100% less than 0.149 mm (100 mesh), however only 30 to 45% being less than 0.044 mm (325 mesh). Therefore, in order to adapt the granulometric characteristics and specific surface of the ore fines to the pelleting process requirements it becomes necessary to submit the ore fines to a crushing stage to reduce the particles size.

In the conventional pelletizing process the reducing of size (crushing and grinding) of the ore fines is achieved by grinding in a tubular mill wherein steel balls or truncated steel cones (cylpebs) are usually employed to help with the grinding operation or as a grinding medium. This grinding operation is a heavy burden on the overall production cost of pellets due to the significant consumption of energy and grinding media.

There are several options available to the grinding operation. It can be performed in or wet or dry, open or closed operations.

In the wet grinding process iron ore and water are mixed together and both are added to the mill in adjusted proportions performing a diluted grounded ore pulp. A large amount of water that is added to the grinding operation is removed by subsequent thickening, homogenizing and filtering stages.

On the other hand, dry grinding operation requires the prior drying of the ore fines, however disregards the water draining step that is necessary when the wet process is employed.

Grinding in an open operation consists in passing the material through the mill only once, while in the closed operation the hydrocyclones employed for wet grinding or the air classifiers used in the dry grinding process perform the granulometric classification at the discharge of the mill.

Finally, in the closed mills a fraction of sufficiently fine material below 0.44 mm (325 mesh) goes on to the next stages of the pelletizing process while the coarser fraction returns to the mill as the circulating load of the grinding process.

SUMMARY OF THE INVENTION

Some years ago, a new crushing technique was tested by the ore mining processing industry. The technology is based on the employment of high pressure to obtain the reduction in the ore particles size. The principle of high pressure crushing was introduced to industrial applications through the machine called roller press in which high pressures, above 50 MPa is applied to two rollers unto which is fed the material to be crushed.

In a roller press the crushing and grinding is achieved through the transfer of pressure between the particles of a bed or layer of material without using any external means of action, such as grinding elements, or coatings in the mill onto the individual particles of the material to be ground. Due to the high pressure as applied, the material which has been processed in a roller press is compacted into a shape of agglomerates called flocks.

Industrial roller presses, such as those which are employed by the cement industry, copper and diamond mines among others, are usually designed with rollers of 1.6 meters in width and 1.4 to 2.2 meters of diameter.

The peripheral velocity of the rollers is from 0.7 to 2.0 m/s and the hydraulic power applied to the rolls ranges of 100 kN per linear roller centimeter, or meters of diameter. The capacity of an industrial roller press may attain up to 1000 tons/h, depending on the dimensions of the equipment, operating conditions and the specific characteristics of the material to be crushed.

The main advantage of the roller press over conventional crushing equipment, such as ball mills and rock crushers are: a significant reduction in electric power of approximately 20 to 30% due to the greater efficiency of energy transfer from the rollers surface to the particles at the beginning and afterwards between the particles; a significant reduction in the operating cost due to (i) the elimination of grinding devices replacement, (ii) preventing fissures and cracks on the ore particles, (iii) consequently reduction of electric power needed for the subsequent stages of comminution, (iv) and the promotion of a greater degree of reactivity of the ore, specially during the interaction with liquids, for example in the leaching process of gold, and the interaction with gases as in the combustion process of coal or in the reduction of ores. Therefore, this provides for a low costs of investment and the improvement of maintenance.

BRIEF DESCRIPTION OF THE DRAWINGS

The present invention will be described in accordance with the attached drawings which are not to be considered as limitations of the present invention.

DETAILED DESCRIPTION OF THE INVENTION

According to the drawings, the present invention comprises a process for the iron ore pellets production in which the pellets are obtained from a comminuted material prepared using a roller press equipment.

Figure 1:
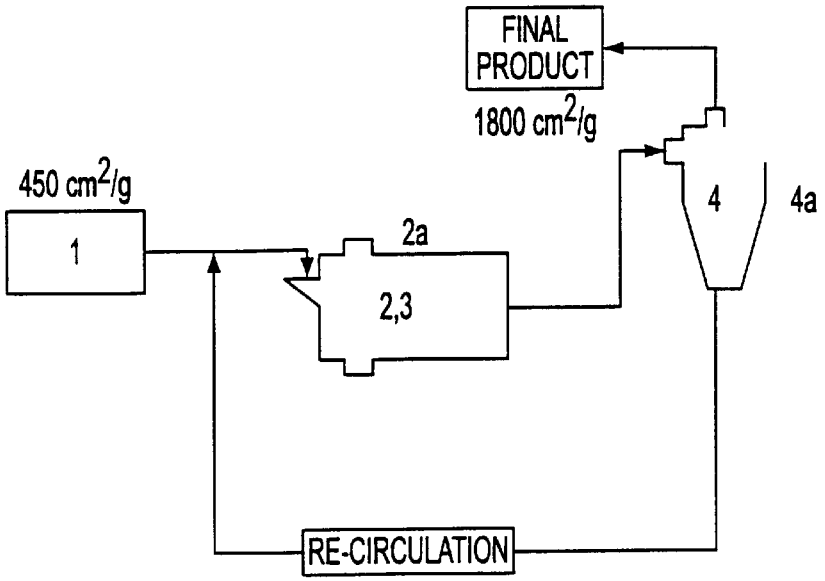
FIG. 1 (PRIOR ART)
FIG. 1 is a schematic viewing of the conventional grinding process of iron ore fines carried out in a ball mill.

FIG. 1 shows the raw material feeding 1 to be pelletized having a high specific surface of about from 450 $cm^2/g$ to 1800 $cm^2/g$ which is not dependent from the particularities of the conventional iron ore production process, being it carried out through a dry or wet, open or closed circuit.

Figure 2:
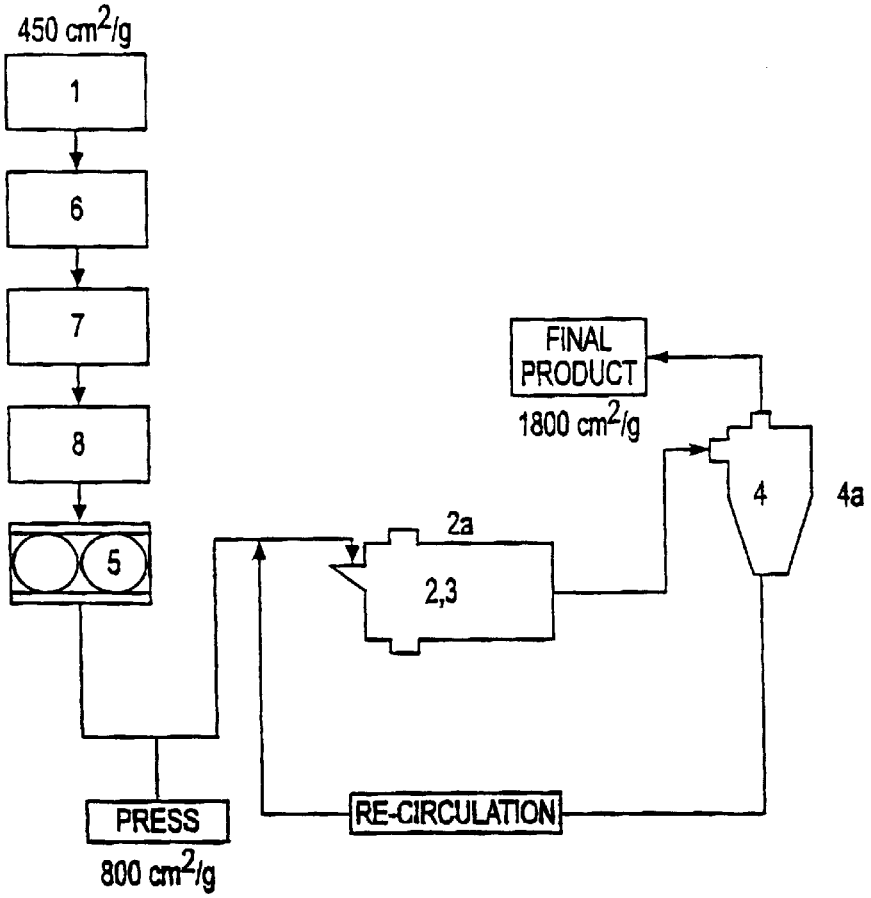
FIG. 2 is a schematic viewing of a process for the iron ore pellets production, comprising a pre-comminution of the iron ore fines in a roller press.

FIG. 2 illustrates an iron ore pellets production process of the present invention wherein the raw material feeding 1 for pelletizing is done in a roller press 5. The material is submitted to roller press 5 at a pre-comminution stage before the pelleting and after that it is immediately submitted to the other stages of conventional grinding in ball mills 2, 3, 4 or 2*a,* and 4*a*. According to this arrangement, the feeding 1 for the ore fines to be transformed in pellets is submitted to a single pass through the roller press 5 resulting in the increase of the specific surface from approximately 450 $cm^2/g$ to about 1800 $cm^2/g$. Then the material is crushed and fed into the conventional wet circuit of the ball mill 2*a* and 4*a,* or the dry 2, 3 and 4, where the specific surface is increased approximately to 1800 $cm^2/g$.

Figure 3:
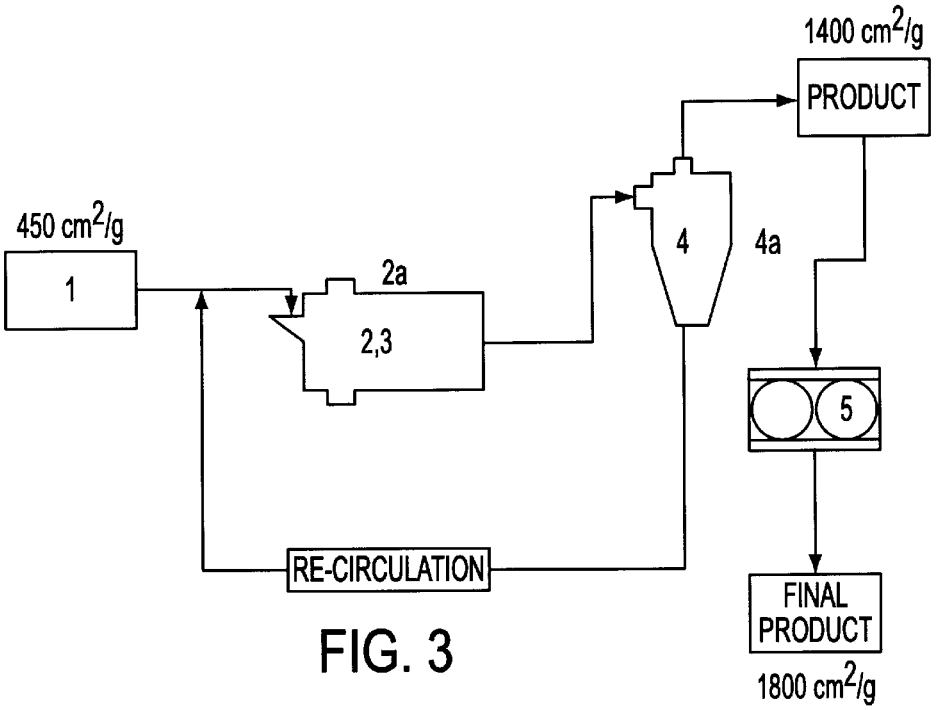
FIG. 3 schematically represents, a process for the iron ore pellets production comprising the post-comminution of the ore fines in a roller press.

FIG. 3 represents an iron ore pellet production process in which the comminution stage of the pelletizing material in the roller press 5 is performed by crushing the material after the conventional grinding in the ball mills 2, 3, 4 or 2*a* and 4*a*. In this case, the iron ore fines feeding 1 has a high specific surface raised from approximately 450 $cm^2/g$ to 1400 $cm^2/g$ in the conventional wet grinding mill 2*a* and 4*a* or the dry grinding mills 2, 3, and 4.

In the case of wet grinding 2*a* and 4*a,* the ground product is submitted to thickening stage 6, homogenizing stage 7 and filtering stage 8. Following the filtered material is crushed in the roller press 5 only once until the specific surface reaches 1800 $cm^2/g$. However, in the case of dry grinding 2, 3 and 4, the ground product with a specific surface of 1400 $cm^2/g$ is submitted to one single passage through the roller press 5 omitting stages 6, 7 and 8, leading to a material with a specific surface of approximately 1800 $cm^2/g$. This arrangement initially implies in the production of a coarser ground material 1 in comparison with the conventional process, since a supplementary comminution shall occur from the processing of this pre-molded material in the roller press 5.

Figure 4A:
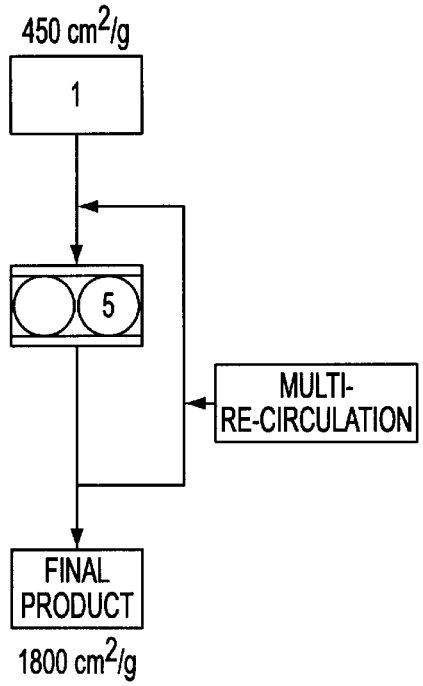
FIGS. 4 and 4*a,* schematically represent two arrangements for a process for the iron ore pellets production with the total comminution of the fines in a roller press.
Figure 4B:
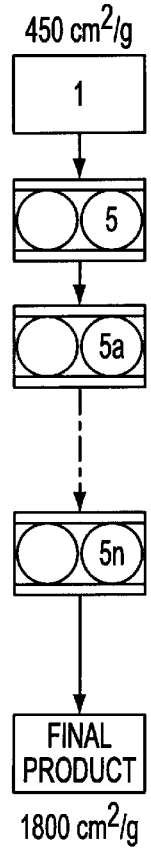

FIG. 4 represents the total comminution of the material to be pelletized wherein the ore fines feeding 1 has the specific surface raised from approximately 450 $cm^2/g$ to about 1800 $cm^2/g$ by the successive passages through the roller press 5. In this arrangement, the conventional wet or dry grinding process 2, 3 and 4, or 2*a* and 4*a* in ball mills is completely substituted by a process with with the single passage through roller press 5. The advantage of this embodiment is that it enables the elimination of the thickening stage 6, homogenization stage 7 and filtering stage 8 which are required in the conventional pelletizing process by the ball mill wet grinding.

In the embodiment shown in FIG. 4A, the conventional wet or dry grinding process in ball mills 2, 3, 4 or 2*a,* 4*a* is completely substituted by the crushing stage in a number (n) of roller presses 5, 5*a,* . . . , 5*n* with one single pass through each press.

FIGS. 5 to 9 show the block diagrams of the tests that have been performed on the variation of arrangements provided in the pelletizing process in which was included at least one crushing stage in roller press 5 which arranged along a pilot plant for the pelletizing process in accordance with the arrangements illustrated in FIGS. 1 to 4*a*. This pilot plant is provided with at least roller presses 5, ball mills 2 and 2*a,* hydrocyclones 11, dryer 12, a thickener 6*a,* homogenizing tank 7*a,* a vacuum rotating filter 8*a,* mixer, pelletizing disk 9 and a pilot furnace 10 for firing the iron ore pellets. The operating productivity of the set of comminution operation was measured for each test.

The quality characteristics of the raw and fired pellets produced during the various tests were evaluated in adequately chemical and physical laboratory for performing pelleting tests.

Figure 5:
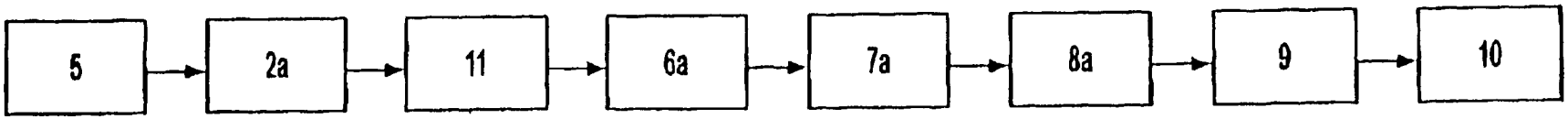
FIG. 5 represents a block diagram of the stages in the production process of iron ore pellets having a crushing stage prior to the wet grinding in the ball mill.
Figure 6:
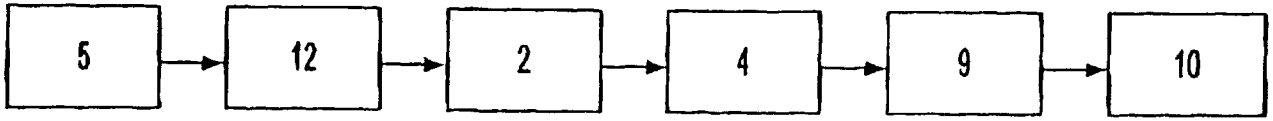
FIG. 6 represents a block diagram of the stages in the production process of iron ore pellets having the crushing stage prior to the dry grinding in the ball mill.
Figure 7:
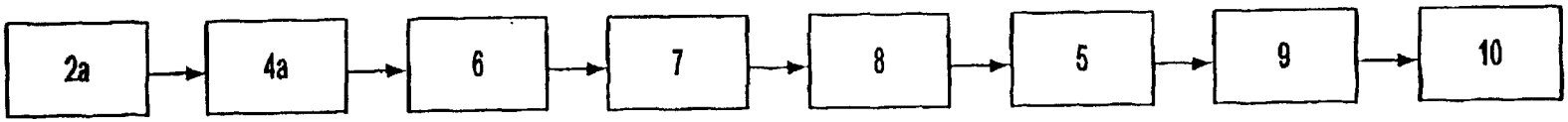
FIG. 7 represents a block diagram of the stages in the production process of iron ore pellets in which the crushing stage is performed after the wet grinding in the ball mill.
Figure 8:
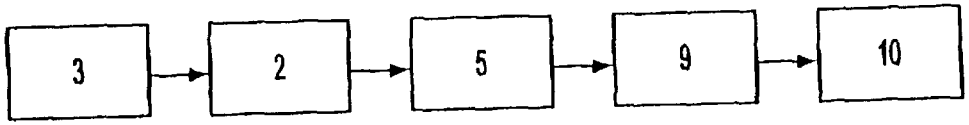
FIG. 8 represents a block diagram of the stages in the production process of iron ore pellets in which the crushing stage is performed after the dry grinding in the ball mill.

To evaluate the process with the pre-comminution stage for the iron ore fines in the roller press 5 followed by the supplementary conventional grinding in the ball mill as illustrated in FIG. 2, three tests were performed with different materials. Two under wet grinding as illustrated in FIG. 5 and one dry grinding as shown in the diagram of FIG. 6. The results of these tests have ascertained that the pre-comminution stage of the fines in the roller press 5 in combination of a supplementary grinding operation in a congenital ball mill produced raw and fired pellets of satisfactory quality and the increasing in the operating productivity ranged 20 to 33%.

For the ore fines post-comminution stage in a roller press 5 after the conventional grinding in ball mills as illustrated in FIG. 3, three tests were performed with different materials. Two with wet grinding shown in the diagram of the FIG. 7 and one with dry grinding as illustrated in the diagram of the FIG. 8. The results of these tests have indicated that the iron ore fines grinding in a ball mill up to a coarser granulometry than that obtained with the conventional process in combination with the post-comminution state via the passage of the pre-ground material through roller presses, it can also be achieved satisfactory quality indices of the processed products. These tests have shown an expressive increase in the operating productivity, between 20 and 36%.

Figure 9:
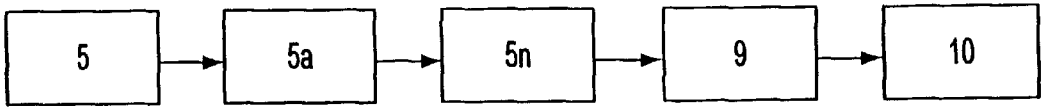
FIG. 9 represents a block diagram of the stages in the production process of iron ore pellets having a series of crushing stage with a total comminution.

For ore fines comminution circuits through successive passages in roller presses 5, 5*a,* . . . , 5*n* as illustrated in FIGS. 4 and 4*a,* three tests were performed with different materials as can be seen in FIG. 9. In each one the material was submitted to a determined number of passages through the recirculation by the roller press 5 until the material reached the desired specific surface. Also, in these tests were obtained results that have shown good quality indices for the raw and fired pellets obtained from successively crushed iron ore fines. The gain in productivity reached in these tests was 26 to 30%.

Therefore, it is possible to conclude that the introduction of roller press equipment in the pelletizing process according to one of the proposed arrangements, FIGS. 2, 3 and 4, afford a considerable increase to the process productivity in the yield of raw or fired pellets at the rate that a portion of the iron ore fines comminution operation 5 is no longer being executed in the conventional ball mills.

In spite of the description and illustrations above be related to a preferred embodiment of the present invention, it is to be understood that changes is possible without any deviations from the scope of the invention.

We claim:

1. A process for iron ore pellets production, comprising the steps of providing at least one roller press and subjecting iron ore to crushing in said roller press to comminute the iron ore for the production of iron ore pellets.

2. The process of claim 1 further comprising a step of grinding the iron ore, said grinding step including at least one of dry grinding wet grinding open grinding and closed grinding, wherein the crushing step is performed independently from said grinding step.

3. The process of claim 2, wherein raw material to be pelletized is fed to said roller press defining a pre-comminution stage of said material and submitting the pre-comminuted material to said grinding step in ball mills.

4. The process of claim 3, wherein the iron ore fines for pelletizing are submitted to one single passage through said roller press resulting in an increase of a specific surface from approximately 450 $cm^2/g$ to about 1800 $cm^2/g$ to obtain a crushed material and feeding the crushed material to a conventional grinding ball mill circuit in which the specific surface is increased to about 1800 $cm^2/g$.

5. The process of claim 2, wherein a material comminution in said crushing step for pelletizing is processed after said grinding step performed in a ball mill.

6. The process of claim 5, wherein iron ore fines have a specific surface increased from approximately 450 $cm^2/g$ to about 1400 $cm^2/g$ in a wet grinding ball mill.

7. The process of claim 6, wherein at a wet grinding step the ground product is submitted to stages of thickening, homogenizing and filtering, followed by said crushing step of the filtered material by passing same only once through the roller press until the specific surface reaches 1800 $cm^2/g$.

8. The process of claim 6, wherein at a dry grinding step the ground product with about a specific surface of 1400 $cm^2/g$ is submitted to a single passage through the roller press resulting in a material with a specific surface of approximately 1800 $cm^2/g$.

9. The process of claim 1, comprising a total communication of the material to be pelletized is provided in said crushing step and wherein iron ore fines having a specific surface increased from approximately 450 $cm^2/g$ are produced in said crushing step by successive passages of the material through a plurality of roller presses.

10. The process of claim 1, wherein a sequence of "n" crushing steps in series are preformed with one single passage of the material through equipment.

* * * * *